US007926168B2

(12) United States Patent
Nierlich

(10) Patent No.: US 7,926,168 B2
(45) Date of Patent: Apr. 19, 2011

(54) METHOD OF MANUFACTURING A COIL

(75) Inventor: Heinz Nierlich, Vienna (AT)

(73) Assignee: NXP B.V., Eindhoven (NL)

( * ) Notice: Subject to any disclaimer, the term of this patent is extended or adjusted under 35 U.S.C. 154(b) by 577 days.

(21) Appl. No.: 11/574,246

(22) PCT Filed: Aug. 16, 2005

(86) PCT No.: PCT/IB2005/052701

§ 371 (c)(1),
(2), (4) Date: Feb. 24, 2007

(87) PCT Pub. No.: WO2006/021915

PCT Pub. Date: Mar. 2, 2006

(65) Prior Publication Data

US 2008/0001016 A1 Jan. 3, 2008

(30) Foreign Application Priority Data

Aug. 27, 2004 (EP) ..... 04104121

(51) Int. Cl.
*H01F 7/06* (2006.01)

(52) U.S. Cl. ..... 29/606; 29/602.1; 29/605; 242/437.3; 242/437.4; 242/443; 242/445.1; 336/212; 336/234; 505/203

(58) Field of Classification Search ..... 29/594, 29/602.1, 605, 606; 242/437.3, 437.4, 443, 242/445.1; 336/212, 234; 505/203
See application file for complete search history.

(56) References Cited

FOREIGN PATENT DOCUMENTS

| | | | |
|---|---|---|---|
| DE | 42 32 882 A1 | | 3/1994 |
| JP | 57101497 A | * | 6/1982 |
| JP | 58-056600 A | | 4/1983 |
| JP | 58-103854 A | | 6/1983 |
| JP | 58-146198 A | | 8/1983 |
| JP | 2002-135891 A | | 5/2002 |

OTHER PUBLICATIONS

International Search Report for Int'l Patent Appln. PCT/IB2005/052701 (May 19, 2006).

* cited by examiner

*Primary Examiner* — Paul D Kim

(57) ABSTRACT

A method of manufacturing a coil having a cross section differing from a circular ring cross section. In this method a circular cylindrical coil with a circular ring cross section is first wound and then reshaped into a coil with a cross section differing from the circular ring cross section. At least two axially parallel fingers of an expander are temporarily inserted into the coil interior for reshaping the wound circular cylindrical coil and are displaced in a diverging relative movement after the insertion and while doing so expand the initially circular cylindrical coil into the coil having the different cross section.

12 Claims, 3 Drawing Sheets

METHOD OF MANUFACTURING A COIL

FIELD OF THE INVENTION

The invention relates to a method of manufacturing a coil with a cross section differing from a circular ring cross section, in which method first a circular cylindrical coil with a cylinder axis and a circular ring cross section is wound and then the circular cylindrical coil is reshaped into the coil with another cross section differing from the circular ring cross section.

The invention further relates to a moving coil for a loudspeaker.

The invention further relates to a loudspeaker with a moving coil.

BACKGROUND OF THE INVENTION

Dynamic loudspeakers achieve a particularly high efficiency, if the cross section of their moving coil is adjusted to the geometry of the membrane. Especially in case of small devices, such as mobile telephones, small loudspeakers with oval or rectangular shape are preferably used. There is a special requirement here for cost-effective manufacturing methods for moving coils with cross sections that are not circular, but of some other shape, especially predominantly rectangular or oval or elliptical.

For the manufacture of moving coils with a substantially rectangular cross section, the coil wire can be wound around square arbors and then held together with an applied adhesive. In order to achieve additional strength and dimensional control, it is necessary to resize the wound coil. In comparison with the manufacture of circular cylindrical coils, the working expenditure is about double, because circular cylindrical coils cannot only be wound faster, but they also have inherently higher strength, so no additional reworking is needed.

Producing coils with a rectangular or square cross section by reshaping a previously made circular cylindrical coil is already known. A method is known from the document JP 57 101 497 A, in which a circular cylindrical coil is put on a reshapable circular cylindrical coil support. A ram is then pressed into the inside of this coil support, which ram has a pointed head part with a pyramid-shaped base part projecting from the head part, which is in the shape of a prism. By pressing this ram, the coil support and the coil put on top are gradually reshaped from the circular cylindrical shape into a non-circular cylindrical shape with a square cross section.

A disadvantage of this known method is especially that a special coil support must be used, which is useless after the reshaping of the circular cylindrical coil and is therefore disposed of. The tapering edges of the pointed pyramid-shaped head part also cause shearing forces to occur which act on the coil through the coil support, which may cause damage to the coil.

Another method is known from the document JP 2002 135 891 A in which the reshaping of a circular cylindrical coil body is done by using a tool with a pointed head part and a base part, which tool is designed in a manner similar to the earlier described ram, where, however, the cross section of the tool, starting from a pointed circular conical head part gradually changes from a circular section into a rectangular section of the base part with a square shape.

This known method too causes undesired force components to act in axial direction, which force components can easily damage the coil to be reshaped or necessitate an appropriately massive coil design.

OBJECT AND SUMMARY OF THE INVENTION

It is an object of the invention to avoid the disadvantages of the order indicated in the opening paragraph and to create an improved method.

To achieve the object defined above, a method as invented has features as invented so that a method as invented can be characterized in the manner mentioned below, namely:

Method of manufacturing a coil with a cross section differing from a circular cylindrical cross section, in which method first a circular cylindrical coil with a cylinder axis and a circular ring cross section is first wound and then the circular cylindrical coil is reshaped into the coil with a cross section different from the circular ring cross section, wherein at least two fingers of an expander running parallel to each other and to the cylinder axis are inserted into the coil interior of the wound circular cylindrical coil for a reshaping of the wound circular cylindrical coil and where after the fingers have been inserted into the coil interior, the fingers make a relative movement transverse to the cylinder axis and diverging, thus expanding the previously circular cylindrical coil into the coil with the other cross section.

For the moving coil as invented for a loudspeaker, the moving coil has been manufactured by a method as invented.

In the case of a loudspeaker as invented with a moving coil, the loudspeaker contains a moving coil as invented.

Providing the features as invented has retained the important advantage that a reshaping of an initially circular cylindrical coil into a coil with a different cross section is made possible without undesirable forces that act in axial direction, i.e. transverse to the winding direction of the wire. The forces of friction between the coil to be reshaped and the fingers of the expander, which occur when reshaping has taken place in accordance with the invention, which forces of friction stress the wire of the coil and/or its insulation, occur only in the direction of winding of the wire and are therefore much less critical than in the known methods. Furthermore, the advantage in the method as invented is that the method as invented does not necessitate any additional throwaway coil support.

The additional provision of measures as claimed in claim 2 provides the advantage that the expansion forces act extremely uniformly on the coil interior.

This is applicable especially if the measure as claimed in claim 3 is additionally provided.

It has also proven to be very advantageous if the measures as claimed in claim 4 are provided in addition. This offers the advantage that a coil is obtained that is especially suitable as a moving coil for loudspeakers with a membrane of a predominantly rectangular shape.

A special advantage provided by the additional provision of the measures as claimed in claim 5 is a geometrically perfect shape of the coil.

The method as invented in its variants is particularly suitable, as claimed in claim 6, for the manufacture of moving coil for a loudspeaker.

These and other aspects of the invention are apparent from and will be elucidated, by way of non-limitative examples, with reference to the embodiment(s) described hereinafter.

BRIEF DESCRIPTION OF THE DRAWINGS

The invention will be elucidated below by way of non-limitative figures referring to two embodiments.

DESCRIPTION OF EMBODIMENTS

The manufacture of a moving coil for a loudspeaker with a rectangular cross section is elucidated below with the help of FIGS. 1 to 4 as an embodiment of the invention.

Figure 5:
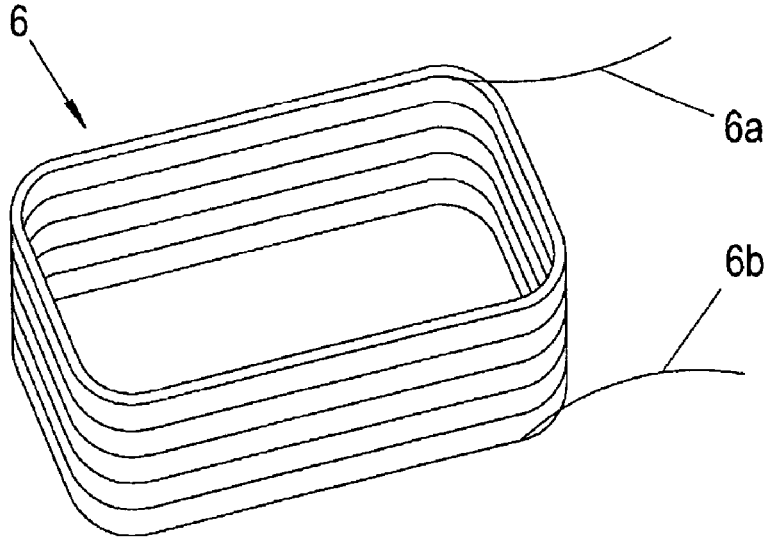
FIG. 5 shows, in a diagonal view a coil with a predominantly rectangular cross section, manufactured in accordance with the method as invented.

Such a coil shown in FIG. 5 can be advantageously used in small loudspeakers e.g. in loudspeakers for mobile telephones.

A circular cylindrical coil 1 with a cylinder axis and with a circular ring cross section is first wound by a method known to those skilled in the art. The coil 1 is then glued using an adhesive to facilitate further handling or make it possible, particularly to avoid the disintegration of the wound coil wire windings. The coil 1 can be wound, for example, from round adhesive varnish wires, which consist of copper or aluminum and have a diameter of 0.02 to 0.1 mm. It is also possible to use other types of wire.

Figure 1:
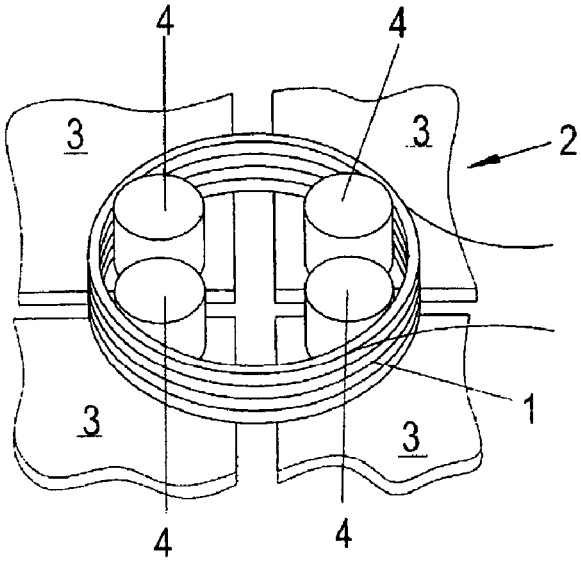
FIG. 1 shows in a diagonal view a circular cylindrical coil put on four fingers of an expander.
Figure 2:
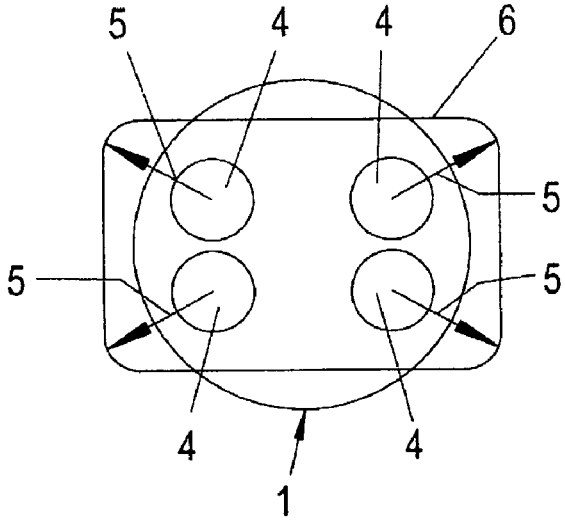
FIG. 2 shows a schematic top view of the coil shown in FIG. 1.
Figure 3:
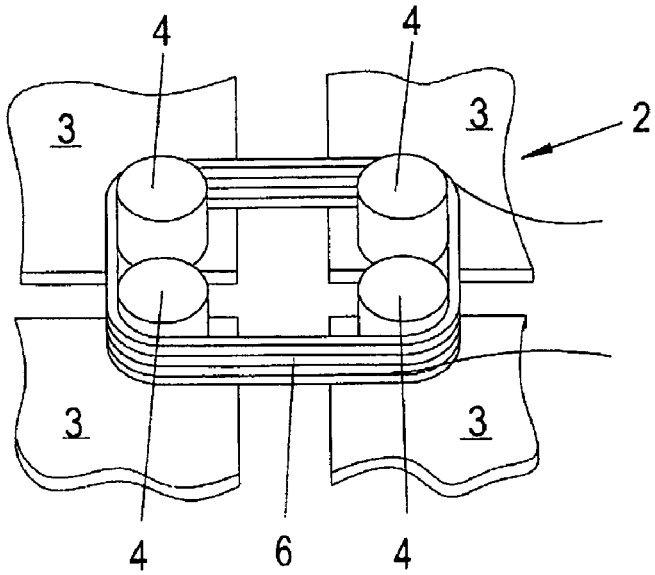
FIG. 3 shows in a manner similar to FIG. 1 the coil reshaped according to the method as invented.

The coil 1 obtained by winding and gluing is now placed onto an expander 2. The expander 2 in the present case has four jaws 3. Each jaw 3 has a finger 4, which is configured as a circular cylindrical rod. The four fingers 4 run parallel to the cylinder axis of the coil 1 and parallel to each other (at least two fingers are provided). The FIGS. 1 and 2 show this phase of the method according to the invention. By placing the coil 1 onto the expander 2, the four fingers 4 are inserted into the coil interior of the wound circular cylindrical coil 1.

In a next step of the method, according to a suitable relative movement taking place transverse to the cylinder axis of the coil 1 of reshaped coil 6 (see FIG. 5), the four jaws 3 and the four fingers 4 are moved away from each other or adjusted. In the present case, in the respective direction of four arrows 5, which are shown in FIG. 2. The four fingers 4 come to rest, during their displacement, on the inner surface of the originally circular cylindrical coil 1 and on further displacement of the four fingers 4, the coil 1 is expanded and the four fingers 4 reshape the coil 1 gradually to a reshaped coil 6, which reshaped coil 6 has a cross section different from the original circular ring cross section, which in the present case is a rectangular cross section. This reshaped coil 6 can be seen in the FIGS. 2, 3, 4 and 5. It should be pointed out that the reshaped coil 6 has only an approximately rectangular cross section, because the shape of the cross section is not exactly a rectangle, because the four corners are rounded, the radius of rounding being determined by the diameter of the four fingers 4.

Figure 4:
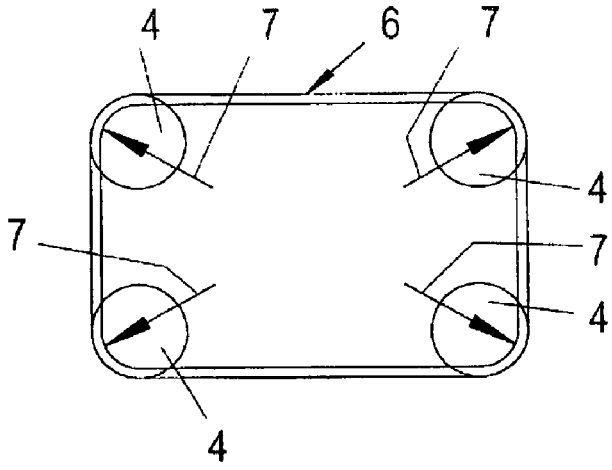
FIG. 4 shows a schematic top view of the reshaped coil shown in FIG. 3.

Four arrows 7 in the FIG. 4 show that the reshaped coil 6 is additionally subjected to elongation after reshaping to a rectangular cross section. In this step of the method, the coil wire of the reshaped coil 6 is elongated only slightly, for example 3 to 5%, which lends additional strength and elasticity to the reshaped coil 6. It is only necessary to select as an expansion parameter the expansion force just high enough to ensure the desired wire elongation. The expanding of the reshaped coil 6 is indicated in FIG. 4 by a double contour line. The reshaped coil 6 is removed from the expander 2 after its expansion, after its four fingers 4 have been suitably moved inwards. The finished reshaped coil 6 is shown in FIG. 5 with its connecting wires 6*a*, 6*b*, where it should be noted that the position, from which the connecting wires 6*a*, 6*b* lead away from the reshaped coil 6 can be freely selected. This advantageous option is not available in the direct winding of rectangular i.e. prismatic coils.

The four fingers 4 need not necessarily be circular cylindrical bars. It is rather more important for the four fingers 4 to come into contact with rounding on the inner surface of the originally circular cylindrical coil 1 and later prismatically reshaped coil 6, so as not to damage the coil wire or its insulation. As a result of the rounding of the four fingers 4 the coil cross section of the coil 6—as already mentioned—is not exactly rectangular, but rectangular "in essence" the geometry of the corner areas being determined by the choice of the diameter or rounding of the fingers.

The invention is not limited to the substantially rectangular coil cross sections. Rather, a method as invented can also be used for the manufacture of prismatic coils with a polygonal cross section (triangular, square, pentagonal, hexagonal etc). Also for the manufacture of non-circular cylindrical coils e.g. coils with a nearly elliptical or oval cross section.

Figure 6:
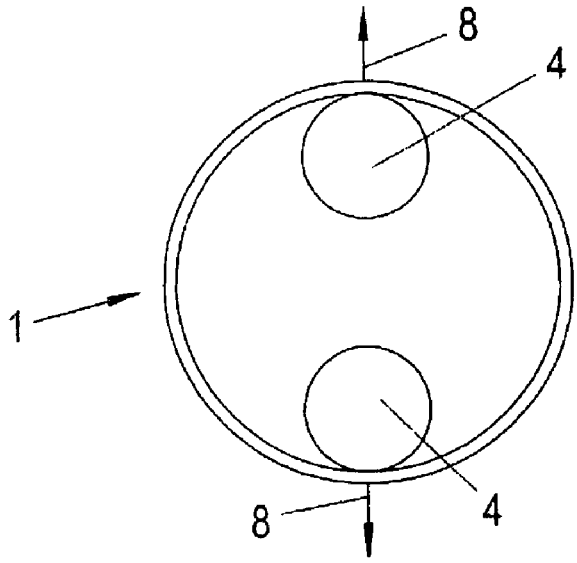
FIG. 6 shows a schematic top view of a circular cylindrical coil before reshaping by using two fingers of an expander.
Figure 7:
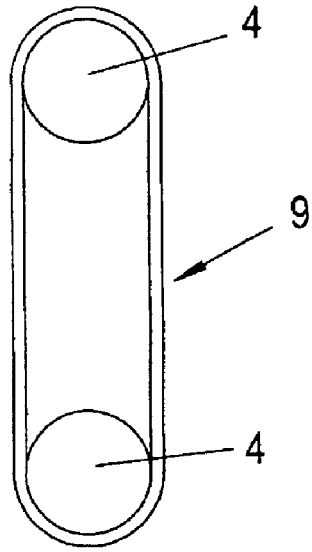
FIG. 7 shows a schematic top view of the coil reshaped by means of two fingers by the method as invented, which coil is obtained from the coil as shown in FIG. 6.
Figure 8:
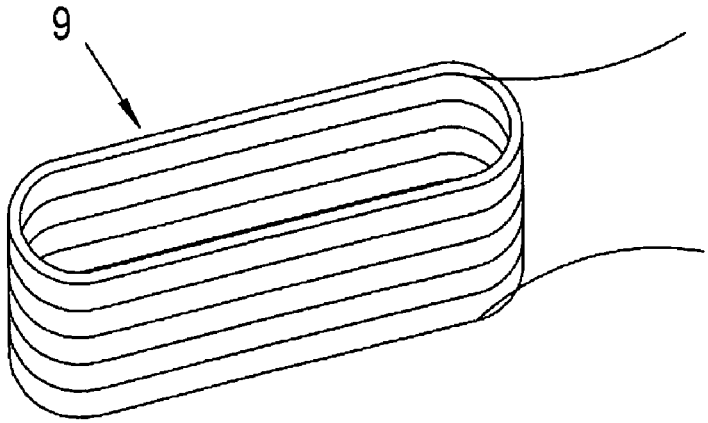
FIG. 8 shows in a diagonal view a coil manufactured in accordance with method steps represented in FIGS. 6 and 7.

Another one of the many possible variants is shown in the FIGS. 6 to 8. This variant relates to the manufacture of a relatively "flat" coil. The starting point is, again, a coil 1 with a circular ring cross section. The circular cylindrical coil 1 is put on an expander with two circular cylindrical fingers 4 after the coil has been wound and glued, so that the two fingers 4 can be inserted into the coil interior of the coil 1. This expander not shown in detail is designed here such that its two fingers 4 are moved relative to each other in the direction of the arrow 8 to reshape the coil 1 and reshape the initially circular cylindrical coil 1 into a reshaped coil 9 having the other cross section evident from the FIGS. 7 and 8. Here too, the expansion force as an expansion parameter can be selected to be so high that the above-mentioned minor elongation of the coil wire of the reshaped coil 9 takes place. The displacement stroke of the two fingers 4 can also be selected as the expansion parameters for elongating the coil wire of the coil 9. In the variant as shown in FIGS. 6 to 8, a first finger 4 can be kept stationary and only the second finger 4 can be made adjustable relative to the first finger 4 transverse to the cylinder axis of the circular cylindrical coil 1. The two fingers 4 may also be formed from hollow cylindrical sleeves.

The invention claimed is:

1. A method of manufacturing a coil with a polygonal cross section, the method comprising:

first winding a circular cylindrical coil with a cylinder axis and a circular ring cross section; and then reshaping the circular cylindrical coil into the coil having the polygonal cross section, wherein the reshaping is accomplished at least in part by inserting a plurality of fingers of an expander, each of the fingers having a portion having an axis, the axes being arranged substantially parallel to the cylinder axis, into a coil interior of the wound circular cylindrical coil for a reshaping of the wound circular cylindrical coil;

wherein after the fingers have been inserted into the coil interior, the fingers make a relative movement transverse to and diverging from the cylinder axis, so that the previously circular cylindrical coil is expanded into the coil having the polygonal cross section; and wherein, after the reshaping, the coil having the polygonal cross section is subjected to elongation by further expansion.

2. The method as claimed in claim 1, wherein each said finger has a rounded portion that contacts a portion of the coil interior.

3. The method as claimed in claim 2, wherein the fingers are substantially circular cylindrical rods.

4. The method as claimed in claim 1, wherein for the manufacture of a coil with an substantially rectangular different cross section four fingers are used for the expansion.

5. The method as claimed in claim 1, wherein at least one expansion parameter is selected such that elongation of the coil wire of the coil is effected with a different cross section.

6. The method as claimed in claim 1, wherein the method is used for manufacturing a moving coil of a loudspeaker.

7. The method as claimed in claim 1, wherein the elongation after reshaping comprises an elongation of approximately 3% to approximately 5%.

8. An apparatus for manufacturing a coil with a cross section differing from a circular ring cross section, the apparatus comprising:

an expander having at least two fingers running parallel to each other; and a mechanism for inserting the fingers into a coil interior of a wound circular cylindrical coil for reshaping of the wound circular cylindrical coil, the coil having a cylinder axis, wherein the mechanism causes the fingers to make a relative movement transverse to the cylinder axis and diverging, to expand the previously circular cylindrical coil into the coil having a cross section differing from a circular ring cross section, and the mechanism thereafter causes the fingers additionally to subject the reshaped coil to elongation after reshaping by a further expansion.

9. The apparatus according to claim 8, wherein the fingers have a rounded portion, by which rounded portion the fingers are configured to contact the coil interior of the circular cylindrical coil.

10. The apparatus according to claim 9, wherein the fingers comprise circular cylindrical rods.

11. The apparatus according to claim 8, comprising four said fingers for the expansion, wherein the apparatus produces a coil having a rectangular cross section.

12. The apparatus according to claim 8, wherein, after reshaping, the apparatus elongates the coil by 3 to 5%.

* * * * *